US012215564B2

(12) United States Patent
Roberts et al.

(10) Patent No.: US 12,215,564 B2
(45) Date of Patent: Feb. 4, 2025

(54) PACKER SYSTEM WITH LOAD BYPASS TO PREVENT PREMATURE EXPANSION

(71) Applicants: CNPC USA Corporation, Houston, TX (US); BEIJING HUAMEI, INC., Beijing (CN); CHINA NATIONAL PETROLEUM CORPORATION, Beijing (CN)

(72) Inventors: Kwami Roberts, Houston, TX (US); Jeff Maynard, Houston, TX (US); Jianpeng Yue, Houston, TX (US); Peng Cheng, Houston, TX (US); Damon Nettles, Houston, TX (US); Perry Batson, Houston, TX (US)

(73) Assignees: CNPC USA Corporation, Houston, TX (US); Beijing Huamei, Inc., Beijing (CN); China National Petroleum Corporation, Beijing (CN)

( * ) Notice: Subject to any disclaimer, the term of this patent is extended or adjusted under 35 U.S.C. 154(b) by 302 days.

(21) Appl. No.: 18/049,374

(22) Filed: Oct. 25, 2022

(65) Prior Publication Data

US 2024/0133263 A1 Apr. 25, 2024
US 2024/0229595 A9 Jul. 11, 2024

(51) Int. Cl.
*E21B 33/128* (2006.01)
*E21B 33/1295* (2006.01)

(52) U.S. Cl.
CPC ..... *E21B 33/1285* (2013.01); *E21B 33/1295* (2013.01)

(58) Field of Classification Search
CPC ..... E21B 33/1285; E21B 33/1295
See application file for complete search history.

(56) References Cited

U.S. PATENT DOCUMENTS

| | | | | |
|---|---|---|---|---|
| 2,338,326 | A | 1/1944 | Green | |
| 3,142,338 | A | 7/1964 | Brown | |
| 3,374,839 | A | 3/1968 | Lebourg | |
| 3,684,010 | A | 8/1972 | Young | |
| 4,423,777 | A | 1/1984 | Mullins et al. | |
| 4,460,040 | A | 7/1984 | Boyer | |
| 5,226,494 | A * | 7/1993 | Rubbo | E21B 34/066 166/66.4 |

(Continued)

FOREIGN PATENT DOCUMENTS

| | | | |
|---|---|---|---|
| CN | 103184850 | A | 7/2013 |
| WO | 2018052404 | A1 | 3/2018 |

*Primary Examiner* — Kristyn A Hall
(74) *Attorney, Agent, or Firm* — Craft Chu PLLC; Andrew W. Chu

(57) ABSTRACT

The packer system includes a packer mandrel, an upper support or gage ring, a seal member, an upper slip device, an upper cone, a lower cone, a lower slip device, a setting sleeve, and a setting piston. The seal member has a run-in position and a set position. The set position seals against a borehole at a location in a borehole. The setting sleeve has a bypass position to transfer load of the setting piston away from the lower slip device and to the lower cone, the seal member, and the upper cone to set the seal member and upper slip device before the lower slip device. The setting sleeve has a released position to separate from the setting piston so that the load of the setting piston can finally be applied on the lower slip device for expansion of the lower slip device at the proper time and location.

17 Claims, 5 Drawing Sheets

(56) References Cited

U.S. PATENT DOCUMENTS

| | | | |
|---|---|---|---|
| 6,378,606 | B1 | 4/2002 | Swor et al. |
| 10,392,897 | B2 | 8/2019 | Wise et al. |
| 10,450,827 | B2 | 10/2019 | Wise et al. |
| 10,989,015 | B2 | 4/2021 | Roy |
| 2016/0186513 | A1 | 6/2016 | Robertson et al. |

* cited by examiner

PACKER SYSTEM WITH LOAD BYPASS TO PREVENT PREMATURE EXPANSION

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to isolating zones in a wellbore. More particularly, the present invention relates a packer system that attaches to a location in the wellbore. Even more particularly, the present invention relates to a packer system with a setting sleeve to bypass load from downhole hydraulic pressure on a lower slip to prevent the lower slip from premature expansion at an unintended location in the wellbore.

2. Description of Related Art Including Information Disclosed Under 37 CFR 1.97 and 37 CFR 1.98

Within a wellbore, the hydrocarbons are located at particular depths within a rock formation. These depths can be organized into production zones so that the delivery of production fluids can be targeted to the location of the hydrocarbons. The production fluids facilitate the recovery of the hydrocarbons from the wellbore. Other depth levels do not contain hydrocarbons, which can be called "non-productive zones". There is no need to waste production fluids on non-productive zones without hydrocarbons. Thus, the productive zones are isolated from the non-productive zones for the recovery of hydrocarbons from the wellbore.

There are known downhole tools to separate a production zone from a non-productive zone so that the production fluids can be delivered to the production zone and not the non-productive zone. Examples of downhole tools to isolate zones include a plug, a packer or other tool with an isolation valve.

In the conventional process, the packer is run downhole into the wellbore. When at the correct location within the wellbore, the packer is expanded against the walls to be fixed at the location within the wellbore. Slip devices from a retracted position are actuated to an expanded position by cone assemblies. In the expanded position or expansion, the slip devices grip the walls of the wellbore to hold the location of the packer. The downhole operations can be performed with the packer fixed at the location.

When setting a packer with hydraulic pressure, fluid is pumped to the bottom of the wellbore. Pressure builds as the fluid fills wellbore, so hydraulic pressure is exerted upwards from the bottom of the wellbore. FIGS. 1-4 show a prior art packer system 1 including a packer mandrel 2, a support or gage ring 3, an upper slip device 4, an upper cone 5, a seal member 6, a lower cone 7, a lower slip device 8, and a setting piston 9. The downhole hydraulic pressure is used for upward pushing tubulars at the bottom of the packer system 1. These tubulars push the setting piston 9 on the lower slip device 8 first, and the lower slip device 8 receives the full pressure of the setting piston 9 to transition from a retracted position to an expanded position.

The lower slip device 8 in the retracted position starts setting the packer system 1 in place. The lower slip device 8 is made strong to resist transition to the expanded position so that the pressure through the lower slip device 8 pushes the lower cone 7, the seal member 6, and the upper cone 5. The pressure through the lower slip device 8 expands the seal member 6 to a sealing diameter, and the upper slip device 4 is expanded by the upper cone 5 to start latching onto the borehole with seal member 6 at the desired location in the borehole. Alternatively, there can be prior art release components, such as a shear pin, that protects the lower slip device 8 from the full pressure of the setting piston 9. However, the full pressure is now on that prior art release component, so the same problem of excess hydraulic pressure cannot be avoided. Prior art stronger lower slips have negative consequences by requiring too much pressure and may never expand to form a stable seal with the packer system.

FIGS. 1-4 also include a prior art version of the strong lower slip device 8 with the high pressure differential needed to break the lower slip device 8. FIG. 3 shows the lower slip device 8 still in the retracted position that has expanded the upper slip device 4 with the upper cone 5 and the seal member 6, before fracturing to seal the lower side of the seal member 6. The components are set by the seal member 6 reaching the sealing diameter, and additional hydraulic pressure is applied to expand the strong lower slip device 8 as in FIG. 4. The packer system 1 is completely dependent on the lower slip device 8 to remain intact for setting. Premature expansion of the lower slip device 8 is fatal in this prior art packer system.

FIGS. 1-2 also include the prior art version of the lower slip device that at least partially transitions the lower slip device 8 form the retracted position to the expanded position, concurrent with the lower slip device 8 pushing the lower cone 7, the seal member 6, and the upper cone 5. In this weaker lower slip device 8, premature expansion of this weaker lower slip device 8 is still problematic. The components are eventually set by the seal member 6 reaching the sealing diameter, but additional hydraulic pressure is applied to expand both the lower slip device 8 and the upper slip device. Moving the seal member 6 at the sealing diameter requires a high pressure differential to push both the expanded or partially expanded lower slip device 8 and the expanded seal member 6 to fully expand the upper slip device 4. When there is insufficient additional hydraulic pressure, the upper slip device 4 is not fully expanded. The packer system remains functional with the seal member 6 and the lower slip device 8, but there is now this additional failure risk. This weaker prior art lower slip device 8 encounters different problems of poorly setting the upper slip device 4 and requiring very high pressure, even if premature expansion of the lower slip device not immediately fatal as in the first prior art version of the strong lower slip device.

Because the lower slip device is so important to set and stabilize the seal of this type of packer system with downhole hydraulic pressure, there is a need to control the quality and strength of the lower slip device so that the packer system can be triggered easily and reliably in the proper location by the other components engaging the lower slip device. For weaker lower slip devices, there can be a load bypass to prevent the premature expansion of the lower slip device, while still properly setting the upper slip device and requiring more easily available downhole hydraulic pressure upwards by a setting piston.

Various patents and publications have been granted for load bypass components in a packer system. U.S. Pat. No. 3,684,010, issued on 15 Aug. 1972 to Young, discloses a compression sleeve that expands and sets a seal member above a slip device before opening the slip device. The pressure on the compression sleeve bypasses the slip device. U.S. Pat. No. 4,460,040, issued on 17 Jul. 1984 to Boyer, discloses an inner body that compresses the seal, while carrying the cone to the correct position for bypassing the slip 70. U.S. Pat. No. 2,338,326, issued on 4 Jan. 1944 to Green, has a mandrel passing through the seal, the cone, and the slips, so that a collar engages the cone to open the slips. The mandrel 13 as a prior art load bypass. U.S. Pat. No. 3,374,839, issued on 26 Mar. 1968 to Lebourg, shows another bypass mandrel.

Other references disclose aspects of the technology. U.S. Pat. No. 6,378,606, issued on 30 Apr. 2022 to Swor et al, describes a conventional packer system set by hydraulic pressure. There is only a lower slip device and seal member. The upper slip device is completely removed, so the seal and support depend only on the seal and the lower slip. The cone expanding the one "lower" slip is not setting the seal member. U.S. Pat. No. 10,392,897, issued on 27 Aug. 2019 to Wise et al and U.S. patent Ser. No. 10/450,827, issued on 22 Oct. 2019 to Wise et al, both describe methods for retrieving a packer by differential pressure that overcomes at least one slip released by a shear pin. Prior art patents can rely on differential pressure, but the components are being used differently, like used for retrieval. U.S. Pat. No. 10,989,015, issued on 27 Apr. 2021 to Roy, only adds a degradeable slip or wedge/cone as the release component. A releasable slip is prior art, but the selection of degrading material is just another trigger that can release the slip from the retracted position to the expanded position.

It is an object of the present invention to provide a packer system to isolate zones in a wellbore for downhole operations.

It is an object of the present invention to provide a packer system to be set in a location within a wellbore by downhole hydraulic pressure.

It is an object of the present invention to provide a packer system with a setting sleeve to prevent premature expansion of a lower slip device of the packer system.

It is another object of the present invention to provide a packer system with a setting sleeve transferring load to a lower cone, a seal member, and an upper cone of the packer system instead of the lower slip device.

It is still another object of the present invention to provide a packer system having the seal member in the set position and an upper slip device in an expanded position before expansion of the lower slip device.

It is another object of the present invention to provide a packer system with a setting sleeve in removable engagement with a setting piston for applying pressure on the lower cone.

It is still another object of the present invention to provide a packer system with a setting sleeve in removable engagement with a setting piston for applying pressure on the lower cone, the seal member, and the upper cone.

It is another object of the present invention to provide a packer system with a setting sleeve with a bypass position relative to the setting piston to transfer load through the lower slip device and to the lower cone.

It is still another object of the present invention to provide a packer system with a setting sleeve with a released position relative to the setting piston to apply pressure on the lower slip device to expand the lower slip device.

It is another object of the present invention to provide a packer system with a setting sleeve to distribute downhole hydraulic pressure to the lower cone, the seal member, the upper cone, and the lower slip device.

It is still another object of the present invention to provide a packer system with a setting sleeve to distribute downhole hydraulic pressure to the lower cone, the seal member, the upper cone, a release component on the setting sleeve in order to bypass the lower slip device, and the lower slip device itself.

These and other objectives and advantages of the present invention will become apparent from a reading of the attached specification, drawings and claims.

BRIEF SUMMARY OF THE INVENTION

Embodiments of the present invention include a packer system having a packer mandrel, an upper support or gage ring, a seal member, an upper slip device, an upper cone, a lower cone, a lower slip device, a setting sleeve, and a setting piston. The seal member has a run-in position with a run-in diameter and a set position with a set diameter. The set diameter is larger than the run-in diameter so as to seal against a borehole, while the run-in diameter corresponds to the packer system being deployed through the borehole to reach a desired location. The upper slip device has an initial upper slip position with the seal member in the run-in position. The initial upper slip position is the retracted position as the narrow configuration of the upper slip device for deploying the packer system through the borehole. The upper slip device is in sliding engagement with the upper cone between the initial upper slip position and an upper slip engaged position. The upper slip engaged position is the expanded position, when the seal member is in the set position. The lower slip device also has an initial lower slip position with the seal member in the run-in position. The initial lower slip position is the retracted position as the narrow configuration of the lower slip device for deploying the packer system through the borehole. The lower slip device is in sliding engagement with the lower cone between the initial lower slip position and a lower slip engaged position. The lower slip engaged position is the expanded position with the seal member in the set position.

In the present invention, the setting sleeve is mounted on the packer mandrel and between the packer mandrel and the lower slip device. The setting sleeve is in removable engagement with the setting piston, which is actuated by downhole hydraulic pressure. The setting sleeve has a bypass position relative to the setting piston with the setting sleeve engaged with the setting piston and a released position relative to the setting piston with setting sleeve separated from the setting piston.

In the bypass position, the setting piston applies pressure to the setting sleeve, and the setting sleeve applies pressure to the lower cone, in turn. The lower slip device is between the setting piston and the lower cone. It also follows that that the setting piston applies pressure on the setting sleeve to the lower cone, directly adjacent and to the seal member and the upper cone. The full pressure of the setting piston is no longer on the lower slip device with the setting sleeve in the bypass position. With the setting sleeve in the bypass position, the load of the setting piston bypasses the lower slip device so that there is less risk of premature expansion.

In the released position of the setting sleeve, the setting piston applies pressure on the lower slip device, instead of the lower cone, the seal member and the upper cone through the setting sleeve. The lower slip device is still in sliding engagement with the lower cone between the initial lower slip position and lower slip engaged position. The setting piston can now expand the lower slip device to the lower slip engaged position.

Embodiments of the setting sleeve of the present invention include a release component on a setting piston end of the setting sleeve so as to separate the setting piston from the setting sleeve. The removable engagement relationship between the setting piston and setting sleeve can be determined by the release component, such as a shear pin, shear screw or shear ring. The release component transitions the setting sleeve from the bypass position to the released position. With the seal member in the set position and the upper slip device in the upper slip engaged position, the lower slip device is the last remaining expandable component of the packer system to be set in the borehole. The release component triggers the transition of the setting sleeve from the bypass position to the released position so that the lower slip device can expand.

In this embodiment, the full pressure of the setting piston is exerted on multiple components (setting sleeve, release component, lower cone, seal member, upper cone) concurrently. Only a portion of the pressure of the setting piston is exerted on the release component in the bypass position. Thus, the release component is also protected from premature breakage. Once the seal member is in the set position and the upper slip device is in the upper slip engaged position, these components are now locked in borehole. More of the full pressure of the setting piston is exerted on the release component. Eventually, the portion of pressure from the setting piston on the release component increases with the seal member and the upper slip device being locked in the borehole. This increased pressure is now sufficient to break the release component. This increased pressure on the release component is only available, when the seal member and the upper slip device are expanded and locked.

The invention also includes the upper support ring or gage ring having an unlocked position on the packer mandrel relative to the seal member and a locked position relative to the seal member. The upper support ring is cooperative with the upper cone to expand the upper slip device with the setting sleeve in the bypass position.

Embodiments of the packer system also include a hydraulic pressure means for the setting piston. The downhole hydraulic pressure for the present invention can be generated by a lower support ring or lower gage ring, an upper piston, a lower mandrel, an upper piston housing, a lower piston, and a bottom sub.

The present invention includes a method for downhole operations with the packer system. The packer system is deployed into a borehole in its narrowest diameter to navigate through the borehole. The setting sleeve is in the bypass position. The packer system reaches a desired location in the wellbore, and the setting piston applies pressure on the setting sleeve. The setting sleeve applies pressure on the lower cone, the seal member and the upper cone with the setting piston. The seal member and the upper slip device expand by the pressure exerted by the setting sleeve in the bypass position. Once the seal member and the upper slip device are expanded, the setting piston is separated from the setting sleeve so as to place the setting sleeve in the released position. The setting piston now engages the lower slip device to apply pressure the lower slip device 80 to slide from the initial lower slip position to the lower slip engaged position. With the three expandable components (upper slip device, seal member, and lower slip device) expanded, downhole operations can be performed in the borehole.

Another embodiment of the method of the present invention includes separating the setting piston from the setting sleeve, when the setting sleeve has a release component. The release component can be sheared by pressure from the setting piston.

The present invention provides a packer system to isolate zones in a wellbore for downhole operations. The packer system and method set the packer system in a location within a wellbore without premature expansion so that the packer system can be set and locked in the proper intended location for the performance of a variety of downhole operations.

BRIEF DESCRIPTION OF THE SEVERAL VIEWS OF THE DRAWINGS

FIG. 8 further includes an enlarged sectional view of the setting sleeve in the bypass position, a lower slip device, lower cone and a setting piston of the present invention.

DETAILED DESCRIPTION OF THE INVENTION

Figure 1:
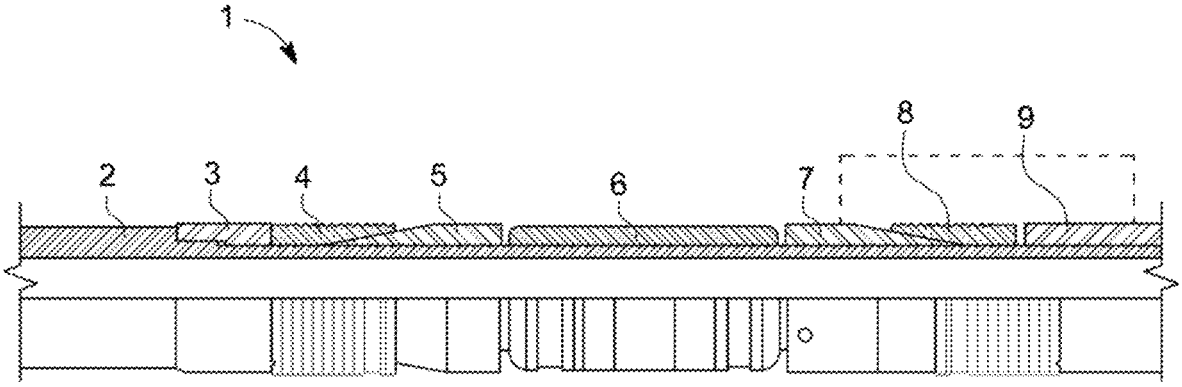
FIG. 1 PRIOR ART
FIG. 1 is a sectional view of a prior art packer system, indicating a Section A in a broken line bracket and showing a lower slip device in a retracted position.
Figure 2:
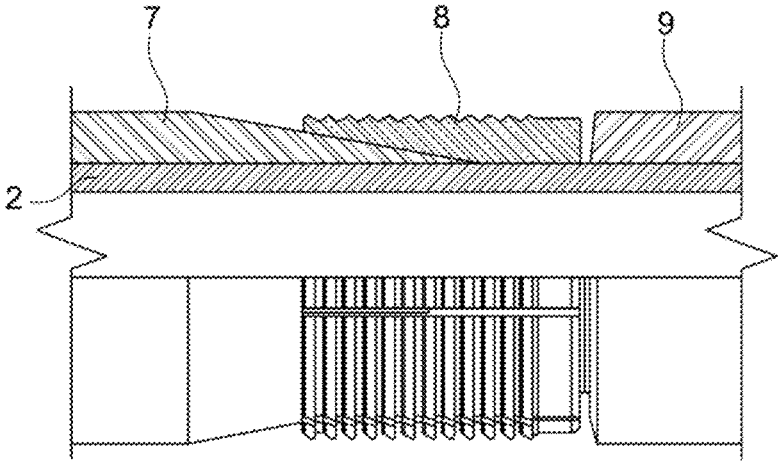
FIG. 2 PRIOR ART
FIG. 2 is an exploded sectional view of Section A from FIG. 1.
Figure 3:
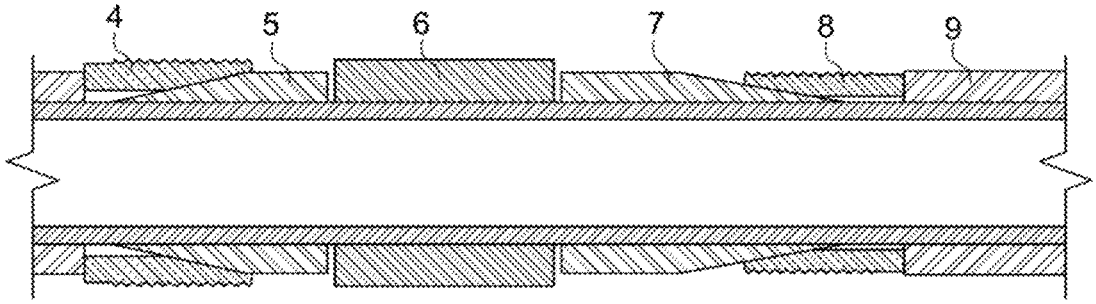
FIG. 3 PRIOR ART
FIG. 3 is a sectional view of the prior art packer system of FIG. 1 showing the transition of the lower slip device from the retracted position to an expanded position.
Figure 4:
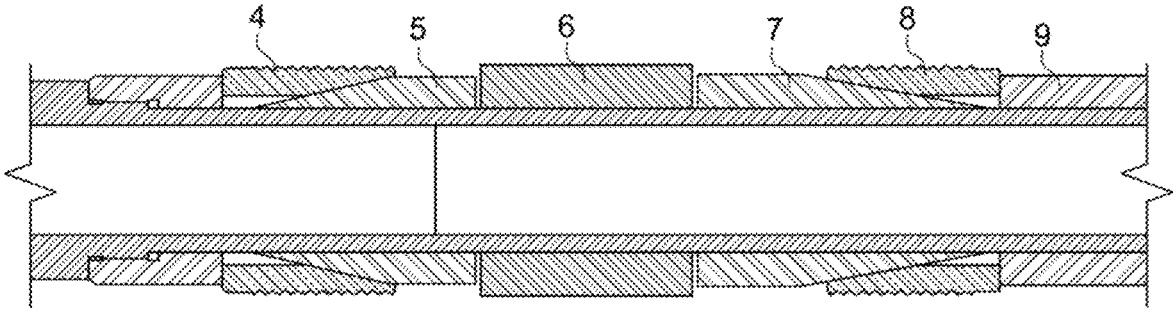
FIG. 4 PRIOR ART
FIG. 4 is a sectional view of the prior art packer system of FIG. 1 showing the lower slip device in the expanded position.

FIGS. 5-12 show embodiments of a packer system 10 according to the present invention. The packer system 10 comprises a packer mandrel 20, an upper support or gage ring 30, a seal member 40, an upper slip device 50, an upper cone 60, a lower cone 70, a lower slip device 80, a setting sleeve 90, and a setting piston 100. The packer mandrel 20 has an upper mandrel end 22 and a lower mandrel end 24, and the upper support ring 30 is positioned at the upper mandrel end 22. The seal member 40 has an upper seal end 42 and a lower seal end 44 opposite the upper seal end. The seal member 40 has a run-in position with a run-in diameter and a set position with a set diameter. The set diameter is larger than the run-in diameter so as to seal against a borehole, while the run-in diameter corresponds to the packer system 10 being deployed through the borehole to reach a desired location.

The upper slip device 50 has an upper support ring end 52 and an upper cone end 54 opposite the upper support ring end. The upper slip device 50 is between the upper support ring 30 and the upper seal end 42 of the seal member 40. The upper slip device 50 has an initial upper slip position with the seal member 40 in the run-in position. The initial upper slip position is the retracted position as the narrow configuration of the upper slip device 50 for deploying the packer system 10 through the borehole.

The upper cone 60 has an upper slip end 62 and an upper sealing end 64 opposite the upper slip end 62. The upper sealing end 64 is positioned so as to exert pressure at the upper seal end 42 on the seal member 40. The upper slip device 50 is in sliding engagement with the upper cone 60 between the initial upper slip position and an upper slip engaged position. The upper slip engaged position is the expanded position, when the seal member 40 is in the set position.

The lower cone 70 has a lower slip end 72 and a lower sealing end 74 opposite the lower slip end 72. The lower sealing end is positioned so as to exert pressure at the lower seal end 44 on the seal member 40.

The lower slip device 80 has a lower setting sleeve end 82, and a lower cone end 84 opposite the lower setting sleeve end 82. The lower slip device 80 also has an initial lower slip position with the seal member 40 in the run-in position. The initial lower slip position is the retracted position as the narrow configuration of the lower slip device 80 for deploying the packer system 10 through the borehole. The lower slip device 80 is in sliding engagement with the lower cone 70 between the initial lower slip position and a lower slip engaged position. The lower slip engaged position is the expanded position with the seal member 40 in the set position.

FIGS. 5-12 show the setting sleeve 90 having a lower cone engagement end 92 and a setting piston end 94 opposite the lower cone engagement end 92. The setting sleeve 90 is mounted on the packer mandrel 20 and between the packer mandrel 20 and the lower slip device 80.

In the present invention, the downhole hydraulic pressure actuates the setting piston 100 having a setting end 102 in removeable engagement with the setting piston end 94 of the setting sleeve 90 so as to apply pressure on the setting sleeve 90 to the lower cone 70. The lower slip device 80 is between the setting piston 100 and the lower cone 70.

Figure 12:
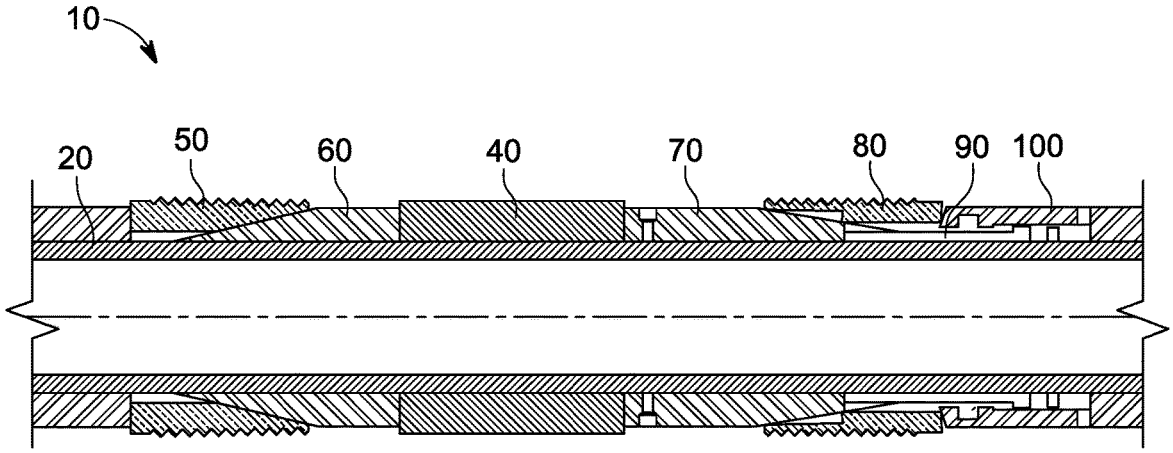
FIG. 12 is an enlarged elevation view of the setting sleeve in a released position, the seal member in the set position, the upper slip device in the upper slip engaged position, and the lower slip device in the lower slip engaged position.

FIGS. 5-11 show the setting sleeve 90 in a bypass position relative to the setting piston 100 with the setting piston end 94 of the setting sleeve 90 removably engaged with the setting piston 100. FIG. 12 shows the setting sleeve 90 in a released position relative to the setting piston 100 with the lower slip device 80 engaged with the setting piston 100. In the bypass position of the setting sleeve 90 of FIGS. 5-11, the setting piston 100 applies pressure on the setting sleeve 90 to the lower cone 70, the seal member 40 and the upper cone 60. The full pressure of the setting piston 100 is no longer on the lower slip device 80. With the setting sleeve 90 in the bypass position, the load of the setting piston 100 bypasses the lower slip device 80 so that there is less risk of premature expansion of the lower slip device 80. The pressure differential is also lower to transition the seal member 40 to the set position and the upper slip device 50 to the upper slip engaged position, which are no longer expanded through a partially expanded or fully expanded prior art lower slip device.

In the released position of the setting sleeve 90 of FIG. 12, the setting piston 10 applies pressure on the lower slip device 80, instead of the lower cone 70, the seal member 40 and the upper cone 60 through the setting sleeve 90. The lower slip device 80 is in sliding engagement with the lower cone 70 between the initial lower slip position and lower slip engaged position. The lower slip engaged position is the expanded position, when the seal member 40 is in the set position. Additionally, the pressure differential to expand the lower slip device 80 is lower than prior art pressure levels, since the lower slip device 80 no longer has to be so strong and resistant to pressure in order to avoid premature expansion. The packer system 10 of the present invention can be set with smaller amounts of pressure and reduce the risk of premature expansion. The lower slip device 80 is in sliding engagement with the setting sleeve 90 in the released position. The lower slip device 80 can slide from the initial lower slip position to lower slip engaged position over both the setting sleeve 90 and the lower cone 70.

In embodiments of the setting sleeve 90 in the bypass position, the setting piston end 94 of the setting sleeve 90 is removably engaged with the setting piston 100 so as to apply pressure on the setting sleeve 90 to the lower cone 70, the seal member 40, and the upper cone 60 through the lower slip device 80. The setting sleeve 90 extends through the lower slip device 80 so that the force exerted by the setting piston 100 is not exerted on the lower slip device 80. The setting sleeve 90 is mounted around the packer mandrel 20, and the lower slip device 80 is mounted around the setting sleeve 90. In this concentric relationship, the pressure on the setting sleeve 90 bypasses the lower slip device 80. The present invention includes a concentric relationship and other physical relationships between the lower slip device 80 and the setting sleeve 90 to bypass the load of the setting piston 100 from the lower slip device 80.

Figure 8:
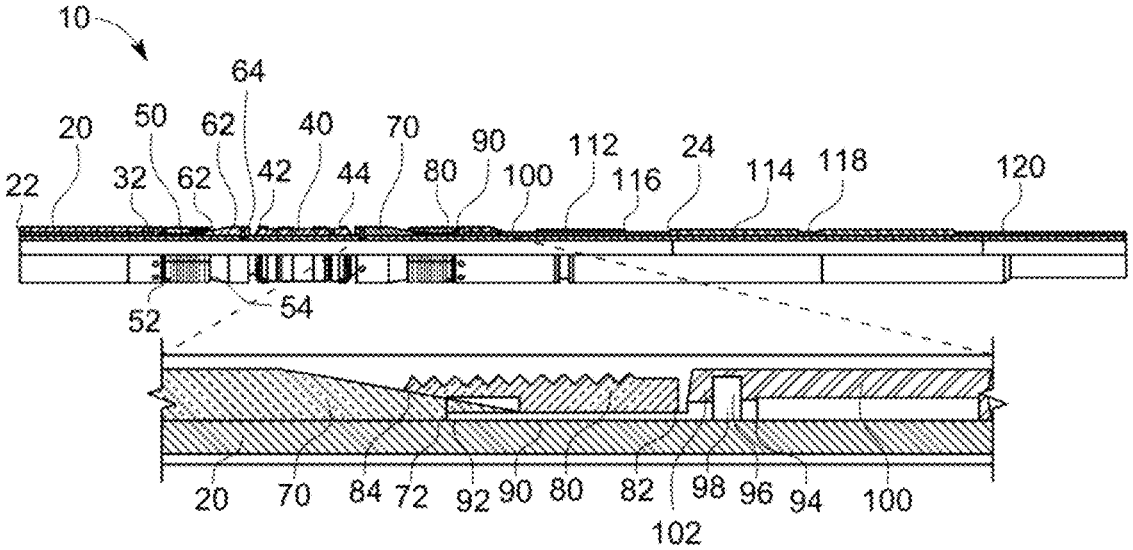
FIG. 8 is another sectional and elevation view of an embodiment of the packer system according to the present invention with the seal member in a run-in position and a setting sleeve in a bypass position.
Figure 9:
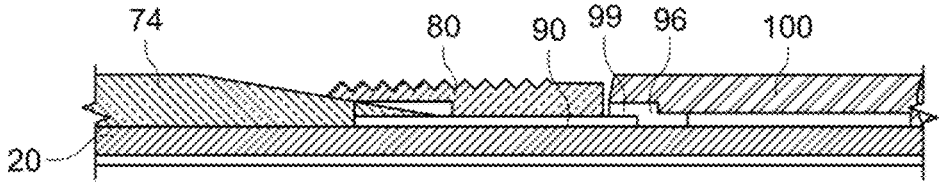
FIG. 9 is an enlarged sectional view, corresponding to the enlarged sectional view of FIG. 8 and showing an alternate embodiment of the setting sleeve in the bypass position.
Figure 10:
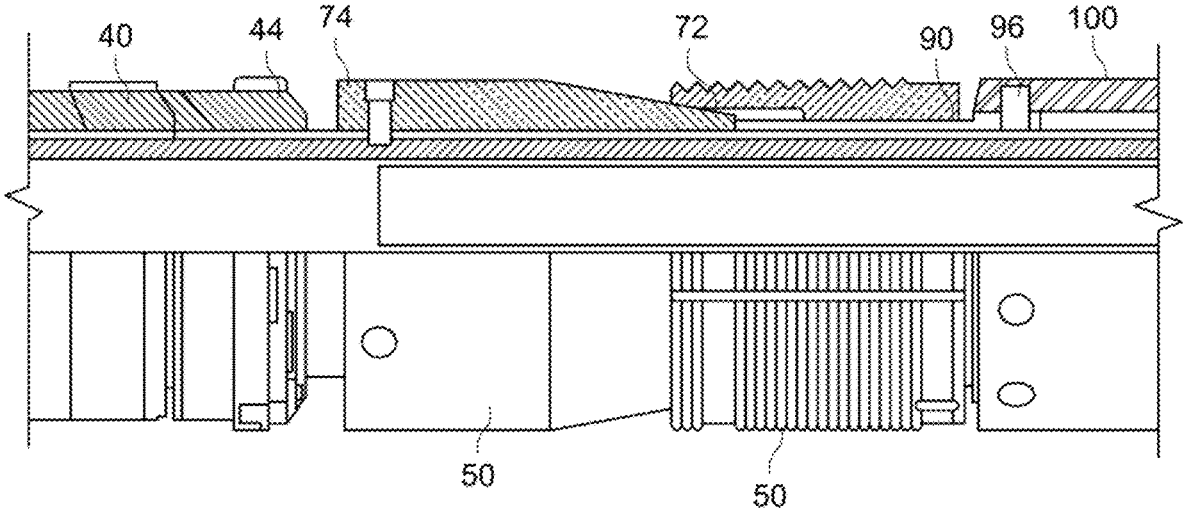
FIG. 10 is another enlarged sectional and elevation view of the setting sleeve in the bypass position, a lower slip device, lower cone and a setting piston of the present invention.
Figure 11:
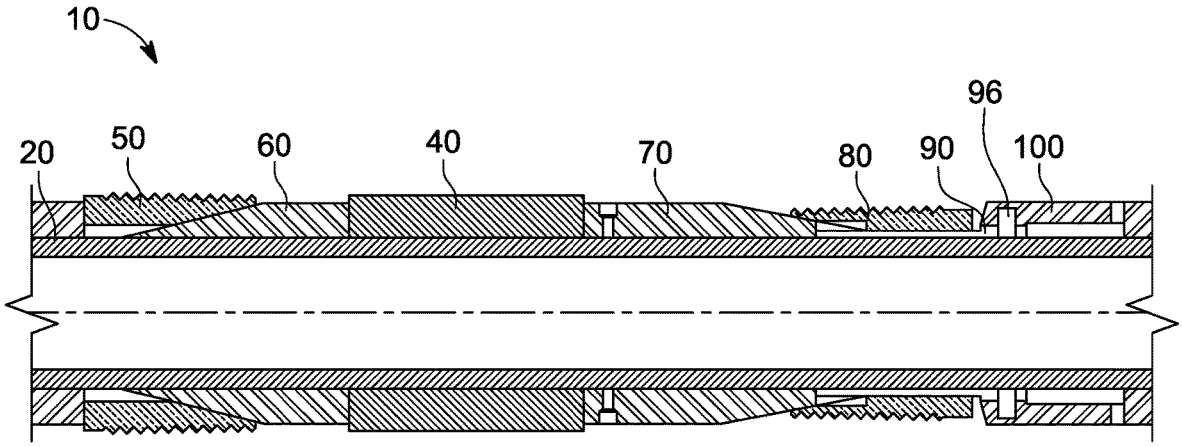
FIG. 11 is an enlarged elevation view of the setting sleeve in the bypass position, the seal member in the set position and the upper slip device in the upper slip engaged position. The lower slip device is prepared to transition the initial lower slip position to the lower slip engaged position.

FIGS. 8-12 show embodiments of the packer system 10 with the setting sleeve 90 being comprised of a release component 96 on the setting piston end 94 so as to separate the setting piston 100 from the setting sleeve 90. FIGS. 8 and 10-12 show the release component 96 as a shear pin 98 or shear screw. FIG. 9 shows the release component 96 as a shear ring 99. The release component 96 transitions the setting sleeve 90 from the bypass position to the released position. The lower slip device 80 must eventually expand to the lower slip engaged position in order to fully set the packer system 10 at the desired location in the borehole. The pressure of the setting piston 100 is still applied to expand the lower slip device 80. With the seal member 40 in the set position and the upper slip device 50 in the upper slip engaged position, the lower slip device 80 is the last remaining component to be set in the borehole. The release component 96 can transition the setting sleeve 90 from the bypass position to the released position.

In this embodiment, the setting sleeve 90 in the bypass position relative to the setting piston applies pressure of the setting piston 100 on the release component 96, the setting sleeve 90, the lower cone 70, the seal member 40, and the upper cone 60. The full pressure of the setting piston 100 is exerted on multiple components concurrently. Only a portion of the pressure of the setting piston 100 is exerted on the release component 96 in the bypass position. Thus, the release component 96 is not subject to premature breakage. The seal member 40 in the set position and the upper slip device 50 in the upper slip engaged position will resist the pressure of the setting piston 100, since these components are now locked in borehole. More of the full pressure of the setting piston 100 is exerted on the release component 96. The portion of pressure from the setting piston 100 on the release component 96 increases with the seal member 40 and the upper slip device 50 locked in the borehole. This increased pressure is now sufficient to break the release component 96. This increased pressure on the release component 96 is only available, when the seal member 40 and the upper slip device 50 are expanded and locked. The risk of premature separation of the setting sleeve 90 and the setting piston 100 is significantly reduced and at least controlled to be after the packer system 10 is ready for any expansion (premature, accidental, or intentional) of the lower slip device 80.

FIGS. 5, 6, 8 and 12 show embodiments of the upper support ring 30 or gage ring having an unlocked position on the packer mandrel 20 relative to the seal member 40 and a locked position relative to the seal member 40. The packer mandrel 20 holds the upper support ring 30 in place on the packer mandrel 20, while the seal member 40 and upper slip device 50 move relative to the upper support ring 30. The pressure of the setting piston 100 on the setting sleeve 90 pushes the upper cone 60 into the upper slip device 50 because the upper support ring 30 holds the upper slip device 50 in place relative to the packer mandrel 20. With pressure, the upper slip device 50 cannot move along the packer mandrel 20; thus, the upper slip device 50 must expand from the initial upper slip position to the upper slip engaged position.

Figure 5:
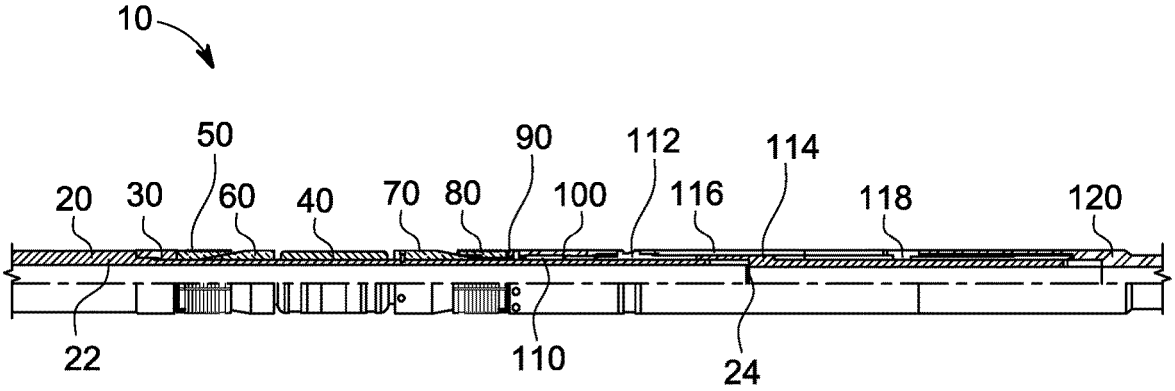
FIG. 5 is a sectional and elevation view of an embodiment of the packer system according to the present invention with the seal member in a run-in position and a setting sleeve in a bypass position.
Figure 6:
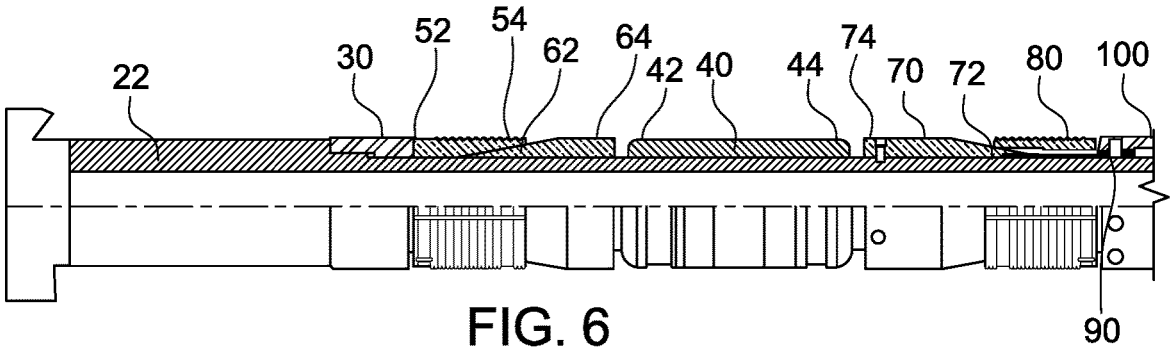
FIG. 6 is an enlarged sectional and elevation view of a portion of the embodiment of the packer system of FIG. 5.
Figure 7:
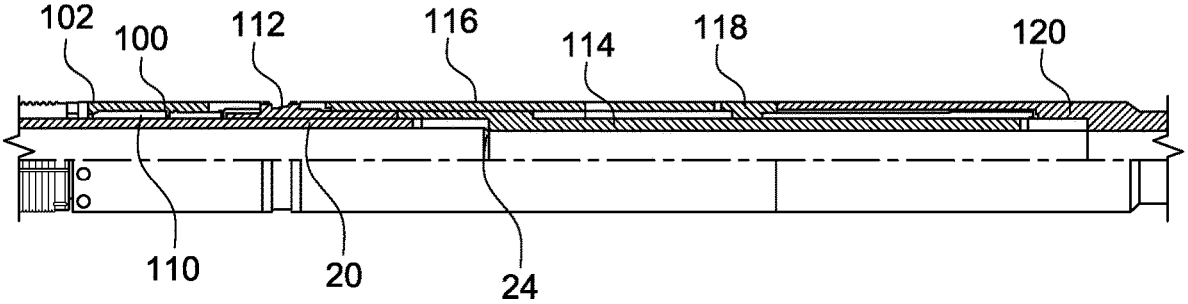
FIG. 7 is an enlarged sectional and elevation view of a remaining portion of the embodiment of the packer system of FIG. 5.

FIGS. 5, 6 and 8 show the unlocked position with the seal member 40 in the run-in position and the upper slip device 50 in the initial upper slip position. FIG. 12 shows the locked position being closer to the seal member 40 than the unlocked position. The upper support ring 30 is in the locked position with the seal member 40 in the set position and the upper slip device 50 in the upper slip engaged position. In the present invention, the upper support ring 30 is in the locked position with both the lower slip device 80 in the lower slip engaged position and the setting sleeve 90 in the released position AND the lower slip device 80 in the initial lower slip position and the setting sleeve 90 in the bypass position. The setting sleeve 90 is separated from the setting piston 100 to transition to the released position, when the seal member 40 is in the set position, which corresponds to the upper support ring 30 in the locked position.

The packer system 10 can also include a hydraulic pressure means for the setting piston 100. The downhole hydraulic pressure for the present invention can be generated by the hydraulic pressure means being comprised of a lower support ring 110 or lower gage ring, an upper piston 112, a lower mandrel 114, an upper piston housing 116, a lower piston 118, and a bottom sub 120. The lower support ring 110 is mounted on the packer mandrel 20 and connected to the setting piston 100. The upper piston 112 is engaged to the setting piston 100 and blocked by the lower support ring 110. The lower mandrel 114 is connected to lower mandrel end 24 of the packer mandrel 20. The upper piston housing 116 is mounted around the upper piston 112, the packer mandrel 20 and lower mandrel 114. The lower piston 118 is mounted around the lower mandrel so as to actuate the setting piston 100 cooperatively with the upper piston 112 within the cavity formed by the upper piston housing 116. The bottom sub 120 attaches to the lower mandrel 118 for the drill string to continue. The hydraulic pressure means of the present invention actuates the setting piston 100 to set the packer system 10 at the desired location in the borehole.

Embodiments of the present invention include a method for downhole operations with the packer system 10. The method includes running the packer system 10 in a borehole, with the seal member 40 in the run-in position, the upper slip device 50 in the initial upper slip position, the lower slip device 80 in the initial lower slip position, and the setting sleeve 90 in the bypass position. The packer system 10 has its smallest diameter in this configuration in order to travel through the borehole. The method includes placing the packer system 10 at a desired location in the wellbore. At the desired location, the setting piston 100 applies pressure on the setting sleeve 90. The setting sleeve 90 applies pressure on the lower cone 70, the seal member 40 and the upper cone 60 with the setting piston 100. The seal member 40 expands from the run-in position to the set position. The upper slip device 50 slides from the initial upper slip position to the upper slip engaged position. The pressure exerted by the setting sleeve 90 to the upper cone 60 pushes the upper cone 60 into the upper slip device 50 to expand the upper slip device 50. The setting sleeve 90 remains in the bypass position. Once the seal member 40 is in the set position and the upper slip device 50 is in the upper slip engaged position, the setting piston 100 is separated from the setting sleeve 90 so as to place the setting sleeve 90 in the released position. The setting piston 100 engages the lower slip device 80 to apply pressure the lower slip device 80 with the setting sleeve 90 in the released position. The lower slip device 80 now slides from the initial lower slip position to the lower slip engaged position with pressure from the setting piston 100. Embodiments of the present invention further include the step of performing downhole operations with the seal member 40 in the set position, the upper slip device 50 being in the upper slip engaged position, and the lower slip device 80 in the lower slip engaged position.

Another embodiment of the method of the present invention includes FIGS. 8-12 showing the setting sleeve 90 being comprised of a release component 96 on the setting piston end 94. In this embodiment of the method, the step of separating the setting piston 100 from the setting sleeve 90 is comprised of shearing the release component 96.

Still another embodiment of the method of the present invention includes FIGS. 5 and 8 showing the hydraulic pressure means being comprised of a lower support ring 110 or lower gage ring, an upper piston 112, a lower mandrel 114, an upper piston housing 116, a lower piston 118, and a bottom sub 120. The lower piston 118 is mounted around the lower mandrel 114 so as to actuate the setting piston 100 cooperatively with the upper piston 112 within the cavity formed by the upper piston housing 116. The step of applying pressure on the setting sleeve 90 further comprises the steps of building downhole hydraulic pressure with the upper piston 112 and lower piston 118 and exerting the hydraulic pressure on the setting piston 100. The upper piston 112 and lower piston 118 are cooperative generate downhole hydraulic pressure on the setting piston 100. It is an object of the present invention to provide a packer system to isolate zones in a wellbore for downhole operations.

The present invention provides a packer system to isolate zones in a wellbore for downhole operations. The packer system and method reliably set the packer system in a location in a controlled and planned manner. The packer system can be set and locked in the location for the performance of a variety of downhole operations. The packer system is set by downhole hydraulic pressure. The setting sleeve of the packer system has a bypass position and a released position to prevent premature expansion of a lower slip device of the packer system. In the present invention, the lower slip device now avoids the fatal premature expansion of the prior art "strong" lower slip device. The present invention also avoids the very high prior art pressure differential needed to expand the seal member and the upper slip device due to the expansion of a prior art "weak" lower slip device. The setting sleeve of the present invention transfers load to a lower cone, a seal member, and an upper cone of the packer system instead of the lower slip device in the bypass position. The seal member can be expanded to the set position, and the upper slip device can be expanded to the upper slip engaged position or expanded position. The setting piston transfers load through the lower slip device and to the lower cone. Then, the lower slip device can be expanded, when the setting sleeve transitions from the bypass position to the released position relative to the setting piston.

The setting sleeve is in removable engagement with a setting piston for applying pressure on the lower cone, the seal member, and the upper cone in the bypass position. In the released position, the setting sleeve is separated from the setting piston so that the setting piston engages the lower slip device. Then, the setting piston can apply pressure on the lower slip device to expand the lower slip device. The downhole hydraulic pressure can now be reliably distributed to the lower cone, the seal member, the upper cone, and then the lower slip device. There can also be a release component on the setting sleeve, which still allows the load bypass through the lower slip device and transfer back to expand the lower slip device. The present invention allows the lower slip device to be fabricated with more standard and conventional materials, instead of specialized and strengthened materials. The lower slip device and the upper slip device can be made of the same materials, instead of the lower slip device requiring special materials for hydraulic pressure setting the packer system. Furthermore, the present invention still avoids the higher pressure differential required of the prior art "weaker" lower slips. The lower slip device is no longer expanded or partially expanded. The seal member and the upper slip device no longer have to be expanded with the additional pressure to expand through an expanded or partially expanded lower slip device. With the setting sleeve and relationship to the setting piston, the seal member and the upper slip device are expanded before the pressure of the setting piston engages the lower slip device and any release component. The present invention resolves the difficulty of premature expansion of the lower slip device without the high pressure differentials required in the prior art.

The foregoing disclosure and description of the invention is illustrative and explanatory thereof. Various changes in the details of the illustrated structures, construction and method can be made without departing from the true spirit of the invention.

We claim:

1. A packer system, comprising:

a packer mandrel having an upper mandrel end and a lower mandrel end;

an upper support ring at said upper mandrel end;

a seal member having an upper seal end and a lower seal end opposite said upper seal end, said seal member having a run-in position with a run-in diameter and a set position with set diameter, said set diameter being larger than said run-in diameter so as to seal against a borehole;

an upper slip device having an upper support ring end, an upper cone end opposite said upper support ring end, and an initial upper slip position with said seal member in said run-in position, said upper slip device being between said upper support ring and said upper seal end;

an upper cone having an upper slip end and an upper sealing end opposite said upper slip end, said upper sealing end positioned so as to exert pressure at said upper seal end on said seal member, said upper slip device being in sliding engagement with said upper cone and having an upper slip engaged position with said seal member in said set position;

a lower cone having a lower slip end and a lower sealing end opposite said lower slip end, said lower sealing end positioned so as to exert pressure at said lower seal end on said seal member;

a lower slip device having a lower setting sleeve end, a lower cone end opposite said lower setting sleeve end, and an initial lower slip position with said seal member in said run-in position, said lower slip device being in sliding engagement with said lower cone and having a lower slip engaged position with said seal member in said set position;

a setting sleeve having a lower cone engagement end and a setting piston end opposite said lower cone engagement end, said setting sleeve being mounted on said packer mandrel and being between said packer mandrel and said lower slip device; and a setting piston having a setting end in removeable engagement with said setting piston end of said setting sleeve so as to apply pressure on said setting sleeve to said lower cone, said lower slip being between said setting piston and said lower cone.

2. The packer system, according to claim 1, wherein said setting sleeve has a bypass position relative to said setting piston with said setting piston end of said setting sleeve removably engaged with said setting piston so as to apply pressure on said setting sleeve to said lower cone, said seal member and said upper cone, and wherein said setting sleeve has a released position relative to said setting position with said lower slip device engaged with said setting piston so as to apply pressure on said lower slip device for sliding engagement with said lower cone to said lower slip engaged position.

3. The packer system, according to claim 2, wherein said setting sleeve has said bypass position relative to said setting piston with said setting piston end of said setting sleeve removably engaged with said setting piston so as to apply pressure on said setting sleeve to said lower cone, said seal member, and said upper cone through said lower slip device.

4. The packer system, according to claim 1, wherein said setting sleeve is comprised of a release component on said setting piston end so as to separate said setting piston from said setting sleeve with said seal member in said set position and said upper slip device in said upper slip engaged position.

5. The packer system, according to claim 4, wherein said release component is comprised of a shear pin.

6. The packer system, according to claim 4, wherein said release component is comprised of a shear ring.

7. The packer system, according to claim 4, wherein said setting sleeve has said bypass position relative to said setting piston with said setting piston end of said setting sleeve removably engaged with said setting piston so as to apply pressure on said setting sleeve to said lower cone, said seal member, said upper cone and said release component concurrently.

8. The packer system, according to claim 1, wherein said upper support ring has an unlocked position on said packer mandrel relative to said seal member and a locked position relative to said seal member, said locked position being closer to said seal member than said unlocked position, said upper support ring being in said locked position with said seal member in said set position, and said upper slip device in said upper slip engaged position.

9. The packer system, according to claim 8, wherein said upper support ring is in said locked position with said lower slip device in said lower slip engaged position and said setting sleeve in said released position.

10. The packer system, according to claim 8, wherein said upper support ring is in said locked position with said lower slip device in said initial lower slip position 2 and said setting sleeve in said bypass position.

11. The packer system, according to claim 1, further comprising: a hydraulic pressure means for said setting piston.

12. The packer system, according to claim 11, wherein the hydraulic pressure means comprises:

a lower support ring on said packer mandrel and connected to said setting piston;

an upper piston engaged to said setting piston and blocked by the lower support ring;

a lower mandrel connected to lower mandrel end;

an upper piston housing around said upper piston, said packer mandrel and lower mandrel;

a lower piston around said lower mandrel so as to actuate said setting piston cooperatively with said upper piston; and a bottom sub attached to said lower mandrel.

13. A method for downhole operations, comprising the steps of:

running a packer system, according to claim 1, in a borehole, with said seal member in said run-in position, said upper slip device in said initial upper slip position, said lower slip device in said initial lower slip position, and said setting sleeve in said bypass position;

placing said packer system at a location in the wellbore;

applying pressure on said setting sleeve with said setting piston;

applying pressure on said lower cone, said seal member, and said upper cone with said setting sleeve;

expanding said seal member from said run-in position to said set position with pressure exerted through the setting sleeve and lower cone, said setting sleeve being in said bypass position;

sliding said upper slip device from said initial upper slip position to said upper slip engaged position with pressure exerted through the setting sleeve, the lower cone, and the seal member, said setting sleeve being in said bypass position;

separating said setting piston from said setting sleeve with said seal member in said set position and said upper slip device in said upper slip engaged position so as to place said setting sleeve in said released position;

applying pressure on said lower slip device with said setting piston with said setting sleeve in said released position; and sliding said lower slip device from said initial lower slip position to said lower slip engaged position with pressure from said setting piston, said setting sleeve being in said released position.

14. The method, according to claim 13, further comprising the step of:

performing downhole operations, after the step of sliding said lower slip device from said initial lower slip position to said lower slip engaged position with pressure from said setting piston, said seal member being in said set position, said upper slip device being in said upper slip engaged position, and said lower slip device being in said lower slip engaged position.

15. The method, according to claim 13, wherein said setting sleeve is comprised of a release component on said setting piston end, and wherein the step of separating said setting piston from said setting sleeve is comprised of: shearing said release component.

16. The method, according to claim 13, wherein the step of applying pressure on said setting sleeve to said lower cone with said setting piston is comprised of:

building downhole hydraulic pressure; and exerting said hydraulic pressure on said setting piston.

17. The method, according to claim 16, wherein said packer system further comprises:

a lower support ring on said packer mandrel and connected to said setting piston;

an upper piston engaged to said setting piston and blocked by the lower support ring;

a lower mandrel connected to lower mandrel end;

an upper piston housing around said upper piston, said packer mandrel and lower mandrel;

a lower piston around said lower mandrel so as to actuate said setting piston cooperatively with said upper piston; and a bottom sub attached to said lower mandrel, and wherein the step of building downhole hydraulic pressure is comprised of the steps of:

building downhole hydraulic pressure with said lower piston and said upper piston.

* * * * *